US005920031A

United States Patent [19]

Jahnke

[11] Patent Number: 5,920,031

[45] **Date of Patent: *Jul. 6, 1999**

[54] WATER-IN-OIL EMULSIONS

[75] Inventor: Richard W. Jahnke, Mentor, Ohio

[73] Assignee: The Lubrizol Corporation, Wickliffe, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/906,070

[22] Filed: Aug. 5, 1997

Related U.S. Application Data

[63] Continuation of application No. 08/242,943, May 16, 1994, abandoned, which is a continuation-in-part of application No. 07/852,859, Mar. 17, 1992, abandoned.

[51] Int. Cl.[6] ..... C06B 45/00

[52] U.S. Cl. ..... 149/2; 149/46; 149/60; 149/77

[58] Field of Search ..... 149/2, 46, 60, 149/77

[56] References Cited

U.S. PATENT DOCUMENTS

| | | | |
|---|---|---|---|
| 3,447,978 | 6/1969 | Bluhm | 149/2 |
| 3,765,964 | 10/1973 | Wade | 149/2 |
| 3,985,593 | 10/1976 | Machacek | 149/62 |
| 4,008,110 | 2/1977 | Machacek | 149/46 |
| 4,097,316 | 6/1978 | Mullay | 149/2 |
| 4,104,092 | 8/1978 | Mullay | 149/2 |
| 4,216,040 | 8/1980 | Sudweeks et al. | 149/21 |
| 4,218,272 | 8/1980 | Brockington | 149/21 |
| 4,234,435 | 11/1980 | Meinhardt et al. | 252/51.5 A |
| 4,259,977 | 4/1981 | Brockington | 137/13 |
| 4,357,184 | 11/1982 | Binet et al. | 149/2 |
| 4,371,408 | 2/1983 | Fillman | 149/21 |
| 4,391,659 | 7/1983 | Smith | 149/2 |
| 4,404,050 | 9/1983 | Yorke et al. | 149/2 |
| 4,409,044 | 10/1983 | Bhattacharyya et al. | 149/22 |
| 4,448,619 | 5/1984 | Mitchell | 149/21 |
| 4,453,989 | 6/1984 | Mullay | 149/21 |
| 4,534,809 | 8/1985 | Takeuchi et al. | 149/3 |
| 4,708,753 | 11/1987 | Forsberg | 149/2 |
| 4,710,248 | 12/1987 | Yates et al. | 149/21 |
| 4,822,433 | 4/1989 | Cooper et al. | 149/2 |
| 4,828,633 | 5/1989 | Forsberg | 149/2 |
| 4,840,687 | 6/1989 | Forsberg et al. | 149/2 |
| 4,844,756 | 7/1989 | Forsberg | 149/2 |
| 4,863,534 | 9/1989 | Forsberg | 149/2 |
| 4,919,178 | 4/1990 | Riga et al. | 149/2 |
| 4,956,028 | 9/1990 | Forsberg et al. | 149/2 |
| 4,999,062 | 3/1991 | Snare et al. | 149/2 |
| 5,034,071 | 7/1991 | Van Ommeren | 149/2 |
| 5,076,867 | 12/1991 | McKenzie | 149/2 |
| 5,129,972 | 7/1992 | Riga et al. | 149/2 |
| 5,221,491 | 6/1993 | Roper et al. | 252/51.5 A |

*Primary Examiner*—Edward A. Miller
*Attorney, Agent, or Firm*—Joseph P. Fischer; James L. Cordek

[57] ABSTRACT

This invention is directed to water-in-oil emulsions which are useful as explosives. These emulsions comprise: a discontinuous aqueous phase comprising at least one oxygen-supplying component; a continuous organic phase comprising at least one carbonaceous fuel; and a minor emulsifying amount of at least one emulsifier. The emulsifier is the product made by the reaction of component (A) with component (B), component (A) being at least one substituted succinic acylating agent, said substituted succinic acylating agent consisting of substituent groups and succinic groups wherein the substituent groups are derived from a polyalkene, said acylating agents being characterized by the presence within their structure of an average of at least 1.3 succinic groups for each equivalent weight of substituent groups, and component (B) being ammonia and/or at least one mono-amine.

40 Claims, No Drawings

WATER-IN-OIL EMULSIONS

This is a continuation of application Ser. No. 08/242,943 filed on May 16, 1994, abandoned, which is a continuation-in-part of application Ser. No. 07/852,859 filed on Mar. 17, 1992, abandoned.

TECHNICAL FIELD

This invention relates to water-in-oil emulsions which are useful as explosives. These emulsions contain at least one emulsifier derived from at least one substituted succinic acylating agent. The substituted succinic acylating agent consists of substituent groups and succinic groups wherein the substituent groups are derived from a polyalkene (e.g., polybutene), said acylating agents being characterized by the presence within their structure of an average of at least 1.3 succinic groups for each equivalent weight of substituent groups.

BACKGROUND OF THE INVENTION

Hydrocarbyl-substituted carboxylic acylating agents having at least about 30 aliphatic carbon atoms in the substituent are known. Examples of such acylating agents include the polyisobutenyl-substituted succinic acids and anhydrides. The use of such carboxylic acylating agents as additives in normally liquid fuels and lubricants is disclosed in U.S. Pat. Nos. 3,288,714 and 3,346,354. These acylating agents are also useful as intermediates for preparing additives for use in normally liquid fuels and lubricants as described in U.S. Pat. Nos. 2,892,786; 3,087,936; 3,163,603; 3,172,892; 3,189,544; 3,215,707; 3,219,666; 3,231,587; 3,235,503; 3,272,746; 3,306,907; 3,306,908; 3,331,776; 3,341,542; 3,346,354; 3,374,174; 3,379,515; 3,381,022; 3,413,104; 3,450,715; 3,454,607; 3,455,728; 3,476,686; 3,513,095; 3,523,768; 3,630,904; 3,632,511; 3,697,428; 3,755,169; 3,804,763; 3,836,470; 3,862,981; 3,936,480; 3,948,909; 3,950,341; and 4,471,091; and French Patent 2,223,415.

U.S. Pat. No. 4,234,435 discloses carboxylic acid acylating agents derived from polyalkenes such as polybutenes, and a dibasic carboxylic reactant such as maleic or fumaric acid or certain derivatives thereof. These acylating agents are characterized in that the polyalkenes from which they are derived have an Mn value of about 1300 to about 5000 and an Mw/Mn value of about 1.5 to about 4. The acylating agents are further characterized by the presence within their structure of at least 1.3 groups derived from the dibasic carboxylic reactant for each equivalent weight of the groups derived from the polyalkene. The acylating agents can be reacted with an amine to produce derivatives useful per se as lubricant additives or as intermediates to be subjected to post-treatment with various other chemical compounds and compositions, such as epoxides, to produce still other derivatives useful as lubricant additives.

Water-in-oil explosive emulsions typically comprise a continuous organic phase (e.g., a carbonaceous fuel) and a discontinuous aqueous phase containing an oxygen-supplying component (e.g., ammonium nitrate). Examples of such water-in-oil explosive emulsions are disclosed in U.S. Pat. Nos. 3,447,978; 3,765,964; 3,985,593; 4,008,110; 4,097,316; 4,104,092; 4,218,272; 4,259,977; 4,357,184; 4,371,408; 4,391,659; 4,404,050; 4,409,044; 4,448,619; 4,453,989; and 4,534,809; and U.K. Patent Application GB 2,050,340A.

U.S. Pat. No. 4,216,040 discloses water-in-oil emulsion blasting agents having a discontinuous aqueous phase, a continuous oil or water-immiscible liquid organic phase, and an organic cationic emulsifier having a lipophilic portion and a hydrophilic portion, the lipophilic portion being an unsaturated hydrocarbon chain.

U.S. Pat. Nos. 4,708,753 and 4,844,756 disclose water-in-oil emulsions which comprise (A) a continuous oil phase; (B) a discontinuous aqueous phase; (C) a minor emulsifying amount of at least one salt derived from (C)(I) at least one hydrocarbyl-substituted carboxylic acid or anhydride, or ester or amide derivative of said acid or anhy- dride, the hydrocarbyl substituent of (C)(I) having an average of from about 20 to about 500 carbon atoms, and (C)(II) ammonia or at least one amine; and (D) a functional amount of at least one water-soluble, oil-insoluble functional additive dissolved in said aqueous phase. The '756 patent discloses that component (C)(II) can also be an alkali or alkaline-earth metal. These emulsions are useful as explosive emulsions when the functional additive (D) is an oxygen-supplying component (e.g., ammonium nitrate).

U.S. Pat. No. 4,710,248 discloses an emulsion explosive composition comprising a discontinuous oxidizer-phase dispersed throughout a continuous fuel phase with a modifier comprising a hydrophilic moiety and a lipophilic moiety. The hydrophilic moiety comprises a carboxylic acid or a group capable of hydrolyzing to a carboxylic acid. The lipophilic moiety is a saturated or unsaturated hydrocarbon chain. The emulsion explosive composition pH is above 4.5.

U.S. Pat. No. 4,822,433 discloses an explosive emulsion composition comprising a discontinuous phase containing an oxygen-supplying component and an organic medium forming a continuous phase wherein the oxygen-supplying component and organic medium are capable of forming an emulsion which, in the absence of a supplementary adjuvant, exhibits an electrical conductivity measured at 60° C., not exceeding 60,000 picomhos/meter. The reference indicates that the conductivity may be achieved by the inclusion of a modifier which also functions as an emulsifier. The modifier is comprised of a hydrophilic moiety and a lipophilic moiety. The lipophilic moiety can be derived from a poly[alk(en)yl] succinic anhydride. Poly(isobutylene) succinic anhydride having a number average molecular weight in the range of 400 to 5000 is specifically identified as being useful. The hydrophilic moiety is described as being polar in character, having a molecular weight not exceeding 450 and can be derived from polyols, amines, amides, alkanol amines and heterocyclics. Example 14 of this reference discloses the use of a 1:1 condensate of polyisobutenyl succinic anhydride (number average molecular weight=1200) and dimethylethanol amine as the modifier/emulsifier.

U.S. Pat. No. 4,828,633 discloses salt compositions which comprise (A) at least one salt moiety derived from (A)(I) at least one high-molecular weight polycaiboxylic acylating agent, said acylating agent (A)(I) having at least one hydrocarbyl substituent having an average of from about 20 to about 500 carbon atoms, and (A)(II) ammonia, at least one amine, at least one alkali or alkaline earth metal, and/or at least one alkali or alkaline earth metal compound; (B) at least one salt moiety derived from (B)(I) at least one low-molecular weight polycarboxylic acylating agent, said acylating agent (B)(I) optionally having at least one hydrocarbyl substituent having an average of up to about 18 carbon atoms, and (B)(II) ammonia, at least one amine, at least one alkali or alkaline earth metal and/or at least one alkali or alkaline earth metal compound; said components (A) and (B) being coupled together by (C) at least one compound having (i) two or more primary amino groups, (ii) two or more secondary amino groups, (iii) at least one primary amino group and at least one secondary amino group, (iv) at least two hydroxyl groups or (v) at least one primary or secondary amino group and at least one hydroxyl group. These salt compositions are useful as emulsifiers in water-in-oil explosive emulsions.

U.S. Pat. Nos. 4,840,687 and 4,956,028 disclose explosive compositions comprising a discontinuous oxidizer phase comprising at least one oxygen-supplying component, a continuous organic phase comprising at least one water-immiscible organic liquid, and an emulsifying amount of at least one nitrogen-containing emulsifier derived from (A) at least one carboxylic acylating agent, (B) at least one polyamine, and (C) at least one acid or acid-producing compound capable of forming at least one salt with said polyamine. Examples of (A) include polyisobutenyl succinic acid or anhydride. Examples of (B) include the alkylene polyamines. Examples of (C) include the phosphorus acids (e.g., O,S-dialkylphosphorotrithioic acid). These explosive compositions can be water-in-oil emulsions or melt-in-oil emulsions.

U.S. Pat. No. 4,863,534 discloses an explosive composition comprising a discontinuous oxidizer phase comprising at least one oxygen-supplying component, a continuous organic phase comprising at least carbonaceous fuel, and an emulsifying amount of (A) at least one salt composition derived from (A)(1) at least one high-molecular weight hydrocarbyl-substituted carboxylic acid or anhydride, or ester or amide derivative of said acid or anhydride, the hydrocarbyl substituent of (A)(1) having an average of from about 20 to about 500 carbon atoms, and (A)(2) ammonia, at least one amine, at least one alkali or alkaline earth metal compound; and (B) at least one salt composition derived from B)(1) at least one low-molecular weight hydrocarbyl-substituted carboxylic acid or anhydride, or ester or amide derivative of said acid or anhydride, the hydrocarbyl substituent of (B)(1) having an average of from about 8 to about 18 carbon atoms, and (B)(2) ammonia, at least one amine, at least one alkali or alkaline earth metal, and/or at least one alkali or alkaline earth metal compound.

U.S. Pat. No. 4,919,178 discloses emulsifiers which comprise the reaction s product of component (I) with component (II). Component (I) comprises the reaction product of certain carboxylic acids or anhydrides, or ester or amide derivatives thereof with ammonia, at least one amine, at least one alkali and/or at least one alkaline-earth metal. Component (II) comprises certain phosphorous-containing acids; or metal salts of said phosphorous-containing acids, the metals being selected from the group consisting of magnesium, calcium, strontium, chromium, manganese, iron, molybdenum, cobalt, nickel, copper, silver, zinc, cadmium, aluminum, tin, lead, and mixtures of two or more thereof These emulsifiers are useful in water-in-oil explosive emulsions.

U.S. Pat. No. 4,956,028 discloses an explosive composition which comprises a discontinuous oxidizer phase comprising at least one oxygen-supplying component, a continuous organic phase comprising at least one water-immiscible organic liquid, and an emulsifying amount of at least one nitrogen-containing emulsifier derived from (A) at least one carboxylic acylating agent (B) at least one polyamine, and (C) at least one acid or acid-producing compound capable of forming at least one salt with said polyamine. These explosive compositions can be water-in-oil emulsions or melt-in-oil emulsions.

U.S. Pat. No. 4,999,062 describes an emulsion explosive composition comprising a discontinuous phase comprising an oxygen-releasing salt, a continuous water-immiscible organic phase and an emulsifier component comprising a condensation product of a primary amine and a poly[alk(en)yl]succinic acid or anhydride and wherein the condensation product comprises at least 70% by weight succinimide product.

Water-in-oil explosive emulsions are often blended with ammonium nitrate prills or ANFO for the purpose increasing the explosive energy of such emulsions. Among the commercially available ammonium nitrate prills that are used are those that are made using one or more crystal habit modifiers to control crystal growth and one or more surfactants to reduce caking. A problem with using these treated prills is that they tend to destabilize the emulsions. It would be advantageous to provide explosive emulsions that remain stable when blended with such treated ammonium nitrate prills.

SUMMARY OF THE INVENTION

This invention is directed to water-in-oil emulsions which are useful as explosives. These emulsions comprise a discontinuous aqueous phase comprising at least one oxygen-supplying component, a continuous organic phase comprising at least one carbonaceous fuel, and a minor emulsifying amount of at least one emulsifier. The emulsifier is the product made by the reaction of component (A) with component (B): component (A) being at least one substituted succinic acylating agent, said substituted succinic acylating agent consisting of substituent groups and succinic groups wherein the substituent groups are derived from a polyalkene, said acylating agents being characterized by the presence within their structure of an average of at least 1.3 succinic groups for each equivalent weight of substituent groups; and component (B) being ammonia and/or at least one amine. In one embodiment these emulsions are stably blended with ammonium nitrate prills that have been made using one or more crystal habit modifiers to control crystal growth and one or more surfactants to reduce caking.

DESCRIPTION OF THE PREFERRED EMBODIMENT

The term "emulsion" as used in this specification and in the appended claims is intended to cover not only water-in-oil emulsions, but also compositions derived from such emulsions wherein at temperatures below that at which the emulsion is formed the discontinuous phase is solid or in the form of droplets of super-cooled liquid. This term also covers compositions derived from or formulated as such water-in-oil emulsions that are in the form of gelatinous or semi-gelatinous compositions.

The term "hydrocarbyl" is used herein to include:

(1) hydrocarbyl groups, that is, aliphatic (e.g., alkyl or alkenyl), alicyclic (e.g., cycloalkyl, cycloalkenyl), aromatic, aliphatic- and alicyclic- substituted aromatic groups and the like as well as cyclic groups wherein the ring is completed through another portion of the molecule (that is, any two indicated groups may together form an alicyclic group);

(2) substituted hydrocarbyl groups, that is, those groups containing non-hydrocarbon groups which, in the context of this invention, do not alter the predominantly hydrocarbyl nature of the hydrocarbyl group; those skilled in the art will be aware of such groups, examples of which include ether, oxo, halo (e.g., chloro and fluoro), alkoxyl, mercapto, alkylmercapto, nitro, nitroso, sulfoxy, etc.;

(3) hetero groups, that is, groups which, while having predominantly hydrocarbyl character within the context of this invention, contain other than carbon in a ring or chain otherwise composed of carbon atoms. Suitable heteroatoms will be apparent to those of skill in the art and include, for example, sulfur, oxygen, nitrogen and such substituents as pyridyl, furanyl, thiophenyl, imidazolyl, etc.

In general, no more than about three nonhydrocarbon groups or heteroatoms and preferably no more than one, will be present for each ten carbon atoms in a hydrocarbyl group. Typically, there will be no such groups or hydrocarbyl group hydrocarbyl group and it will, therefore, be purely hydrocarbyl.

The hydrocarbyl groups are preferably free from acetylenic unsaturation; ethylenic unsaturation, when present will generally be such that there is no more than one ethylenic linkage present for every ten carbon-to-carbon bonds. The hydrocarbyl groups are often completely saturated and therefore contain no ethylenic unsaturation.

The term "lower" as used herein in conjunction with terms such as alkyl, alkenyl, alkoxy, and the like, is intended to describe such groups which contain a total of up to 7 carbon atoms.

The inventive water-in-oil emulsions, which are useful as explosives, comprise a discontinuous aqueous phase comprising at least one oxygen-supplying component, a continuous organic phase comprising at least one carbonaceous fuel, and a minor emulsifying amount of at least one emulsifier. In one embodiment, these emulsions are stably blended with ammonium nitrate prills that have been treated with surfactants and crystal growth modifiers.

The continuous organic phase is preferably present at a level of at least about 2% by weight, more preferably in the range of about 2% to about 15% by weight, more preferably in the range of about 3.5% to about 10%, more preferably about 5% to about 8% by weight based on the total weight of the water-in-oil emulsion. The discontinuous aqueous phase is preferably present at a level of at least about 85% by weight, more preferably at a level in the range of about 85% to about 98% by weight, more preferably about 92% to about 95% by weight based on the total weight of the emulsion. The emulsifier is preferably present at a level in the range of about 5% to about 95%, more preferably about 5% to about 50%, more preferably about 5% to about 20%, more preferably about 10% to about 20% by weight based on the total weight of the organic phase. The oxygen-supplying component is preferably present at a level in the range of about 70% to about 95% by weight, more preferably about 75% to about 92% by weight, more preferably about 78% to about 90% by weight based on the total weight of the aqueous phase. The water is preferably present at a level in the range of about 5% to about 30% by weight, more preferably about 8% to about 25% by weight, more preferably about 10% to about 22% by weight based on the weight of the aqueous phase.

The Carbonaceous Fuel

The carbonaceous fuel that is useful in the emulsions of the invention can include most hydrocarbons, for example, paraffinic, olefinic, naphthenic, aromatic, saturated or unsaturated hydrocarbons, and is typically in the form of an oil or a wax or a mixture thereof. In general, the carbonaceous fuel is a water-immiscible, emulsifiable hydrocarbon that is either liquid or liquefiable at a temperature of up to about 95° C., and preferably between about 40° C. and about 75° C. Oils from a variety of sources, including natural and synthetic oils and mixtures thereof can be used as the carbonaceous fuel.

Natural oils include animal oils and vegetable oils (e.g., castor oil, lard oil) as well as solvent-refined or acid-refined mineral oils of the paraffinic, naphthenic, or mixed paraffin-naphthenic types. Oils derived from coal or shale are also useful. Synthetic oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); alkyl benzenes (e.g., dodecylbenzenes, tetradecylbenzenes, dinonylbenzenes, di-(2-ethylhexyl) benzenes, etc.); polyphenyls (e.g., biphenyls, terphenyls, alkylated polyphenyls, etc.); and the like.

Another suitable class of synthetic oils that can be used comprises the esters of dicarboxylic acids (e.g., phthalic acid, succinic acid, alkyl succinic acid, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, pentaerythritol, etc.). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethyl-hexanoic acid, and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another class of useful oils. These include tetraethyl-silicate, tetraisopropylsilicate, tetra-(2-ethylhexyl)-silicate, tetra-(4-methyl-hexyl)-silicate, tetra(p-tert-butylphenyl)silicate, hexyl(4-methyl-2-pentoxy)-disiloxane, poly(methyl)-siloxanes, poly-(methylphenyl)-siloxanes, etc. Other useful synthetic oils include liquid esters of phosphorus-containing acid (e.g., tricresyl phosphate, trioctyl phosphate, diethyl ester of decane phosphonic acid, etc.), polymeric tetrahydrofurans, and the like.

Unrefined, refined and rerefined oils (and mixures of each with each other) of the type disclosed hereinabove can be used. Unrefined oils are those obtained directly from a natural or synthetic source without further purification treatment. For example, a shale oil obtained directly from a retorting operation, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such as solvent extraction, distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed toward removal of spent additives and oil breakdown products.

Examples of useful oils include a white mineral oil available from Witco Chemical Company under the trade designation KAYDOL; a white mineral oil available from Shell under the trade designation ONDINA; and a mineral oil available from Pennzoil under the trade designation N-750-HT. Diesel fuel (e.g., Grade No. 2-D as specified in ASTM D-975) can be used as the oil.

The carbonaceous fuel can be any wax having melting point of at least about 25° C., such as petrolatum wax, microcrystalline wax, and paraffin wax, mineral waxes such as ozocerite and montan wax, animal waxes such as spermacetic wax, and insect waxes such as beeswax and Chinese wax. Useful waxes include waxes identified by the trade designation MOBILWAX 57 which is available from Mobil Oil Corporation; D02764 which is a blended wax available from Astor Chemical Ltd.; and VYBAR which is available from Petrolite Corporation. Preferred waxes are blends of microcrystalline waxes and paraffin.

In one embodiment, the carbonaceous fuel includes a combination of a wax and an oil. The wax content can be at least about 25% and preferably in the range of about 25% to about 90% by weight of the organic phase, and the oil content can be at least about 10% and preferably ranges from about 10% to about 75% by weight of the organic phase.

The Oxygen-Supplying Component

The oxygen-supplying component is preferably at least one inorganic oxidizer salt such as ammonium, alkali or alkaline earth metal nitrate, chlorate or perchlorate. Examples include ammonium nitrate, sodium nitrate, calcium nitrate, ammonium chlorate, sodium perchlorate and ammonium perchlorate. Ammonium nitrate is preferred. Mixtures of ammonium nitrate and sodium or calcium nitrate are also useful. In one embodiment, inorganic oxidizer salt comprises principally ammonium nitrate, although up to about 25% by weight of the oxidizer phase can comprise either another inorganic nitrate (e.g., alkali or alkaline earth metal nitrate) or an inorganic perchlorate (e.g., ammonium perchlorate or an alkali or alkaline earth metal perchlorate) or a mixture thereof.

The Emulsifier

The terms "substituent" and "acylating agent" or "substituted succinic acylating agent" are to be given their normal meanings. For example, a substituent is an atom or group of atoms that has replaced another atom or group in a molecule as a result of a reaction. The term acylating agent or substituted succinic acylating agent refers to the compound per se and does not include unreacted reactants used to form the acylating agent or substituted succinic acylating agent.

The substituted succinic acylating agent (A) utilized in the preparation of the emulsifier can be characterized by the presence within its structure of two groups or moieties. The first group or moiety is referred to hereinafter, for convenience, as the "substituent group(s)" and is derived from a polyalkene. The polyalkene from which the substituted groups are derived is characterized by an Mn (number average molecular weight) value of at least about 500, more preferably at least about 1000, more preferably at least about 1300, more preferably at least about 1500. Advantageously, the polyalkene has an Mn in the range of about 500 to about 10,000, more preferably about 1000 to about 7000, more preferably about 1300 to about 5000, more preferably about 1500 to about 5000, more preferably about 1500 to about 3000, more preferably about 1500 to about 2400, more preferably about 1500 to about 2000, more preferably about 1600 to about 1900. The polyalkene preferably has an Mw/Mn value of at least about 1.5, preferably from about 1.5 to about 5, more preferably about 2 to about 5, more preferably about 2.8 to about 5, more preferably about 2.8 to about 4.5, more preferably about 3.3 to about 3.9. The abbreviation Mw is the conventional symbol representing the weight average molecular weight.

Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC. The techniques for determining Mn and Mw values of polymers are well known and are described in numerous books and articles. For example, methods for the determination of Mn and molecular weight distribution of polymers is described in W. W. Yan, J. J. Kirkland and D. D. Bly, "Modem Size Exclusion Liquid Chromatographs", J. Wiley & Sons, Inc., 1979.

Polyalkenes having the Mn and Mw values discussed above are known in the art and can be prepared according to conventional procedures. For example, some of these polyalkenes are described and exemplified in U.S. Pat. No. 4,234,435. The disclosure of this patent relative to such polyalkenes is hereby incorporated by reference. Several such polyalkenes, especially polybutenes, are commercially available.

The second group or moiety in the acylating agent is referred to herein as the "succinic group(s)". The succinic groups are those groups characterized by the structure (I)

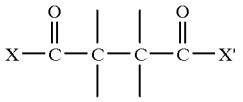

wherein X and X' are the same or different provided that at least one of X and X' is such that the substituted succinic acylating agent can function as a carboxylic acylating agent. That is, at least one of X and X' must be such that the substituted acylating agent can form, for example, amides, imides or amine salts with amino compounds, and esters, ester-salts, amides, imides, etc., with the hydroxyamines, and otherwise function as a conventional carboxylic acid acylating agent. Transesterification and transamidation reactions are considered, for purposes of this invention, as conventional acylating reactions.

Thus, X and/or X' is usually —OH, —O-hydrocarbyl, —O-$M^+$where $M^+$represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C(O)X and —C(O)X') can enter into acylation reactions.

One of the unsatisfied valences in the grouping

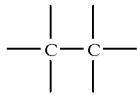

of Formula I forms a carbon-to-carbon bond with a carbon atom in the substituent group. While other such unsatisfied valence may be satisfied by a similar bond with the same or different substituent group, all but the said one such valence is usually satisfied by hydrogen; i.e., —H.

The substituted succinic acylating agents are characterized by the presence within their structure of an average of at least 1.3 succinic groups (that is, groups corresponding to Formula I) for each equivalent weight of substituent groups. These acylating agents can have from about 1.5 to about 2.5, preferably about 1.7 to about 2.1, more preferably about 1.8 to about 2.0 succinic groups for each equivalent weight of substituent group. For purposes of this invention, the equivalent weight of substituent groups is deemed to be the number obtained by dividing the Mn value of the polyalkene from which the substituent is derived into the total weight of the substituent groups present in the substituted succinic acylating agents. Thus, if a substituted succinic acylating agent is characterized by a total weight of substituent group of 40,000 and the Mn value for the polyalkene from which the substituent groups are derived is 2000, then that substituted succinic acylating agent is characterized by a total of 20 (40,000/2000=20) equivalent weights of substituent groups. Therefore, that particular succinic acylating agent must also be characterized by the presence within its structure of at least 26 (1.3×20=26) succinic groups.

The ratio of succinic groups to equivalents of substituent groups present in the acylating agent can be determined by one skilled in the art using conventional techniques (e.g., acid number, saponification number).

In one embodiment, the succinic groups correspond to the formula (II)

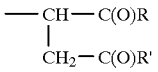

wherein R and R' are each independently selected from the group consisting of —OH, —Cl, —O— lower alkyl, and when taken together, R and R' are —O—. In the latter case, the succinic group is a succinic anhydride group. All the succinic groups in a particular succinic acylating agent need not be the same, but they can be the same. Preferably, the succinic groups correspond to (III)

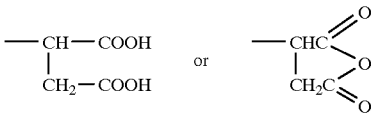

(a) (b)

and mixtures of III(a) and III(b). Providing substituted succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

The preferred characteristics of the succinic acylating agents are intended to be understood as being both independent and dependent. They are intended to be independent in the sense that, for example, a preference for a minimum of 1.4 or 1.5 succinic groups per equivalent weight of substituent groups is not tied to a more preferred value of Mn or Mw/Mn. They are intended to be dependent in the sense that, for example, when a preference for a minimum of 1.4 or 1.5 succinic groups is combined with more preferred values of Mn and/or Mw/Mn, the combination of preferences does in fact describe still further more preferred embodiments of the invention. Thus, the various parameters are intended to stand alone with respect to the particular parameter being discussed but can also be combined with other parameters to identify further preferences. This same concept is intended to apply throughout the specification with respect to the description of preferred values, ranges, ratios, reactants, and the like unless a contrary intent is clearly demonstrated or apparent.

The polyalkenes from which the substituent groups are derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C═C<); that is, they are monoolefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterized by the presence in their structure of the group >C═$CH_2$. However, polymerizable internal olefin monomers (sometimes referred to in the literature as medial olefins) characterized by the presence within their structure of the group

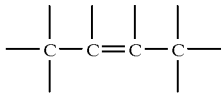

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, pentadiene-1,3 (i.e., piperylene) is deemed to be a terminal olefin for purposes of this invention.

Some of the substituted succinic acylating agents (A) useful in preparing the inventive emulsifiers are known in the art and are described in, for example, U.S. Pat. No. 4,234,435, the disclosure of which is hereby incorporated by reference. The acylating agents described in the '435 patent are characterized as containing substituent groups derived from polyalkenes having an Mn value of about 1300 to about 5000, and an Mw/Mn value of about 1.5 to about 4.

There is a general preference for aliphatic, hydrocarbon polyalkenes free from aromatic and cycloaliphatic groups. Within this general preference, there is a further preference for polyalkenes which are derived from the group consisting of homopolymers and interpolymers of terminal hydrocarbon olefins of 2 to about 16 carbon atoms. This further preference is qualified by the proviso that, while interpolymers of terminal olefins are usually preferred, interpolymers optionally containing up to about 40% of polymer units derived from internal olefins of up to about 16 carbon atoms are also within a preferred group. A more preferred class of polyalkenes are those selected from the group consisting of homopolymers and interpolymers of terminal olefins of 2 to about 6 carbon atoms, more preferably 2 to 4 carbon atoms. However, another preferred class of polyalkenes are the latter more preferred polyalkenes optionally containing up to about 25% of polymer units derived from internal olefins of up to about 6 carbon atoms. The polybutenes and polyisobutenes are particularly preferred. In one embodiment, the polyalkene is a polybutene in which at least about 50% of the total units derived from butenes is derived from isobutene. In one embodiment, the polyalkene is an interpolymer or copolymer of ethylene and propylene, or an interpolymer or copolymer of styrene and at least one diene (e.g., butadiene, pentadiene, isoprene, etc.).

The preparation of polyalkenes as described above which meet the various criteria for Mn and Mw/Mn is within the skill of the art and does not comprise part of the present invention. Techniques readily apparent to those skilled in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents of this invention, one or more of the above-described polyalkenes is reacted with one or more acidic reactants selected from the group consisting of maleic or fumaric reactants of the general formula $$X(O)C—CH=CH—C(O)X' \quad (IV)$$

wherein X and X' are as defined hereinbefore in Formula I. Preferably the maleic and fumaric reactants will be one or more compounds corresponding to the formula $$RC(O)—CH=CH—C(O)R' \quad (V)$$

wherein R and R' are as previously defined in Formula II herein. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents of the present invention. The especially preferred reactants are maleic acid, maleic anhydride, and mixtures of these. Due to availability and ease of reaction, maleic anhydride will usually be employed.

For convenience and brevity, the term "maleic reactant" is sometimes used to refer to the acidic reactants used to prepare the succinic acylating agents. When used, it should be understood that the term is generic to acidic reactants selected from maleic and fumaric reactants corresponding to Formulae (IV) and (V) above including mixtures of such reactants.

Examples of patents describing various procedures for preparing useful acylating agents include U.S. Pat. Nos. 3,215,707; 3,219,666; 3,231,587; 3,912,764; 4,110,349; 4,234,435; and 5,041,662; and U.K. Patents 1,440,219 and 1,492,337. The disclosures of these patents are hereby incorporated by reference for their teachings with respect to the preparation of substituted succinic acylating agents.

The acylating agents described above are intermediates in the process for preparing the emulsifier for the inventive emulsion, the process comprising reacting (A) one or more acylating agents with (B) ammonia and/or at least one mono-amine.

The amines (B) useful in making the emulsifiers include primary amines, secondary amines and tertiary mono-amines, with the secondary and tertiary amines being preferred and the tertiary amines being particularly useful. Hydroxy mono-amines, especially tertiary alkanol monoamines, are useful. Mixtures of two or more amines can be used.

The amines can be aliphatic, cycloaliphatic, aromatic or heterocyclic, including aliphatic-substituted aromatic, aliphatic-substituted cycloaliphatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted cycloaliphatic and heterocyclic-substituted aromatic amines. These amines may be saturated or unsaturated. If unsaturated, the amine is preferably free from acetylenic unsaturation. The amines may also contain non-hydrocarbon substituents or groups as long as these groups do not significantly interfere with the reaction of the amines with the acylating agents (A). Such non-hydrocarbon substituents or groups include lower alkoxy, lower alkyl, mercapto, nitro, and interrupting groups such as —O— and —S— (e.g., as in such groups as $—CH_2CH_2—X—CH_2CH_2—$ where X is —O— or —S—).

With the exception of the high molecular weight hydrocarbyl-substituted amines described more fully hereinafter, the amines used in this invention ordinarily contain less than about 40 carbon atoms in total and usually not more than about 20 carbon atoms in total.

Aliphatic monoamines include mono-aliphatic, di-aliphatic and tri-aliphatic substituted amines wherein the aliphatic groups can be saturated or unsaturated and straight or branched chain. Such amines include, for example, mono-, di- and tri-alkyl-substituted amines; mono-, di- and tri-alkenyl-substituted amines; amines having one or more N-alkenyl substituents and one or more N-alkyl substituents, and the like. The total number of carbon atoms in these aliphatic monoamines preferably does not exceed about 40 and usually does not exceed about 20 carbon atoms. Specific examples of such monoamines include ethylamine, di-ethylamine, tri-ethylamine, n-butylamine, di-n-butylamine, alkylamine, isobutylamine, cocoamine, stearylamine, laurylamine, methyl-laurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenylethylamine, and 3-(furylpropyl) amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamines, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines and pyranyl-substituted cyclohexylamine.

Suitable aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthylene. Examples of aromatic monoamines include aniline, di(para-methylphenyl) amine, naphthylamine, N-(n-butyl) aniline, and the like. Examples of aliphatic-substituted, cycloaliphatic-substituted, and heterocyclic-substituted aromatic monoamines include para-ethoxyaniline, para-dodecylaniline, cyclohexyl-substituted naphthylamine and thienyl-substituted aniline.

Heterocyclic mono-amines can also be used. As used herein, the terminology "heterocyclic mono-amine(s)" is intended to describe those heterocyclic amines containing at least one primary, secondary or tertiary amino group and at least one nitrogen as a heteroatom in the heterocyclic ring. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain heteroatoms other than nitrogen, especially oxygen and sulfur. The 5- and 6-membered heterocyclic rings are preferred.

Among the suitable heterocyclics are aziridines, azetidines, azolidines, tetra- and di-hydro pyridines, pyrroles, indoles, piperadines, isoindoles, morpholines, thiomorpholines, N-aminoalkyl-morpholines, N-aminoalkylthiomorpholines, azepines, and tetra-, di- and perhydroderivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, thiomorpholines, morpholines, pyrrolidines, and the like. Piperidine, aminoalkyl-substituted piperidines, morpholine, aminoalkyl-substituted morpholines, pyrrolidine, and aminoalkyl-substituted pyrrolidines, are useful.

The tertiary monoamines can be represented by the formula

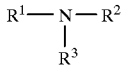

wherein $R^1$, $R^2$ and $R^3$ are the same or different hydrocarbyl groups. Preferably, $R^1$, $R^2$ and $R^3$ are independently hydrocarbyl groups of from 1 to about 20 carbon atoms. Examples of useful tertiary amines include trimethyl amine, triethyl amine, tripropyl amine, tributyl amine, monomethyldiethyl amine, monoethyldimethyl amine, dimethylpropyl amine, dimethylbutyl amine, dimethylpentyl amine, dimethylhexyl amine, dimethylheptyl amine, dimethyloctyl amine, dimethylnonyl amine, dimethyldecyl amine, dimethyldicodanyl amine, dimethylphenyl amine, N,N-dioctyl-1-octanamine, N,N-didodecyl-1-dodecanamine tricoco amine, trihydrogenated-tallow amine, N-methyl-dihydrogenated tallow amine, N,N-dimethyl-1-dodecanamine, N,N-dimethyl-1-tetradecanamine, N,N-dimethyl-1-hexadecanamine, N,N-dimethyl-1-octadecanamine, N,N-dimethylcoco, amine, N,N-dimethyl soyaamine, N,N-dimethyl hydrogenated tallow amine, etc.

Hydroxyamines, both mono-amines, analogous to those mono-amines described herein are also useful. The hydroxy-substituted amines contemplated are those having hydroxy substituents bonded directly to a carbon atom other than a carbonyl carbon atom; that is, they have hydroxy groups capable of functioning as alcohols. The hydroxyamines can be primary, secondary or tertiary amines, with the secondary and tertiary amines being preferred, and the tertiary amines being especially preferred. The terms "hydroxyamine" and "aminoalcohol" describe the same class of compounds and, therefore, can be used interchangeably.

The hydroxyamines include N-(hydroxyl-substituted hydrocarbyl) amines, hydroxyl-substituted poly (hydrocarbyloxy) analogs thereof and mixtures thereof. These include secondary and tertiary alkanol amines represented, respectfully, by the formulae:

(VI)

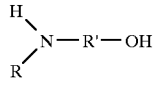

and (VII)

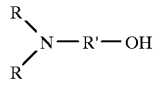

wherein each R is independently a hydrocarbyl group of one to about eight carbon atoms or hydroxy-substituted hydrocarbyl group of two to about eight carbon atoms and R' is a divalent hydrocarbyl group of about two to about 18 carbon atoms. The group —R'—OH in such formulae represents the hydroxyl-substituted hydrocarbyl group. R' can be an acyclic, alicyclic or aromatic group. Typically, R' is an acyclic straight or branched alklene group such as an ethylene, 1,2-propylene, 1,2-butylene, 1,2-octadecylene, etc. group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each R is a lower alkyl group of up to seven carbon atoms.

Examples of the N-(hydroxyl-substituted hydrocarbyl) amines include di- and triethanolamine, dimethylethanolamine, diethylethanolamine, di-(3-hydroxylpropyl) amine, N-(3-hydroxylbutyl) amine, N-(4-hydroxylbutyl) amine, N,N-di-(2-hydroxylpropyl) amine, N-(2-hydroxylethyl) morpholine and its thio analog, N-(2-hydroxylethyl) cyclohexylamine, N-3-hydroxyl cyclopentylamine, o-, m- and p-amninophenol.

In a particularly advantageous embodiment, the hydroxyamine is a compound represented by the formula

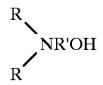

wherein each R is independently an alkyl group of 1 to about 4 carbon atoms, preferably 1 or 2 carbon atoms, and R' is an alkylene group of 2 to about 4 carbon atoms, preferably about 2 or 3 carbon atoms. In an especially useful embodiment, the hydroxyamine is dimethylethanolamine.

The hydroxyamines can also be ether N-(hydroxy-substituted hydrocarbyl)amines. These are hydroxyl-substituted poly(hydrocarbyloxy) analogs of the above-described hydroxy amines (these analogs also include hydroxyl-substituted oxyalkylene analogs). Such N-(hydroxyl-substituted hydrocarbyl) amines can be conveniently prepared by reaction of epoxides with aforedescribed amines and can be represented by the formulae:

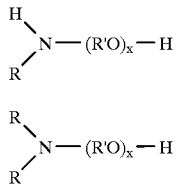

wherein x is a number of about 2 to about 15, and R and R' are as described above with respect to Formulae (VI) and (VII).

Also suitable as amines are the aminosulfonic acids and derivatives thereof corresponding to the formula:

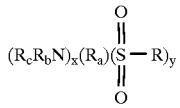

wherein R is OH, $NH_2$, $ONH_4$, etc.; $R_a$ is a polyvalent organic group having a valence equal to x+y; $R_b$ and $R_c$ are each independently hydrogen, hydrocarbyl or substituted hydrocarbyl with the proviso that at least one of $R_b$ and $R_c$ is hydrogen per aminosulfonic acid molecule; x=1 and y is an integer equal to or greater than one. Each aminosulfonic reactant is characterized by at least one HN< or $H_2N$— group and at least one

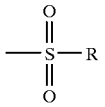

group. These sulfonic acids can be aliphatic, cycloaliphatic or aromatic aminosulfonic acids and the corresponding functional derivatives of the sulfo group. Specifically, the aminosulfonic acids can be aromatic aminosulfonic acids, that is, where $R_a$ is a polyvalent aromatic group such as phenylene where at least one

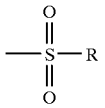

group is attached directly to a nuclear carbon atom of the aromatic group. The aminosulfonic acid may also be a mono-amino aliphatic sulfonic acid; that is, an acid where x is one and $R_a$ is a polyvalent aliphatic group such as ethylene, propylene, trimethylene, and 2-methylene propylene. Other suitable aminosulfonic acids and derivatives thereof useful as amines in this invention are disclosed in U.S. Pat. Nos. 3,029,250; 3,367,864; and 3,926,820; which are incorporated herein by reference for their disclosure of mono-aminosulfonic acids.

The high molecular weight hydrocarbyl monoamines which can be used as amines in this invention are generally prepared by reacting a chlorinated polyolefin having a molecular weight of at least about 400 with ammonia or an amine. The amines that can be used are known in the art and described, for example, in U.S. Pat. Nos. 3,275,554 and 3,438,757, both of which are incorporated herein by reference. These amines must possess at least one primary or secondary amino group.

The carboxylic derivative compositions produced from the acylating agents (A) and ammonia or the amines (B) described hereinbefore comprise acylated amines which typically include one or more amine salts, amides, imides and/or imidazolines as well as mixtures of two or more thereof. When the amine (B) is a hydroxyamine, the carboxylic derivative compositions usually include esters and/or ester-salts (e.g., half-ester and half-salt). The amine salt can be an external salt wherein the ionic salt linkage is formed between the acylating agent (A) and a nitrogen atom from the amine (B); the amine is not otherwise bonded to the acylating agent. The amine salt can also be an internal salt wherein the acylating agent (A) and amine (B) are bonded to each other through a non-salt linkage (e.g., an ester linkage) and a nitrogen atom from the bonded amine forms a salt linkage with the acylating agent. Examples of these salts are as follows:

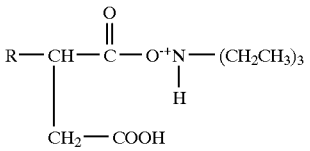

(External Salt)

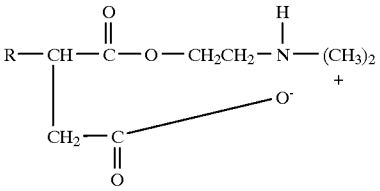

(Internal Salt)

wherein R is a polyalkene (e.g., polybutene) group.

To prepare the carboxylic acid derivative compositions from the acylating agents (A) and ammonia or the amines (B), one or more acylating agents and one or more of ammonia and/or amines are heated, optionally in the presence of a normally liquid, substantially inert organic liquid solvent/diluent, at temperatures in the range of about 30° C. up to the decomposition point of the reactant or product having the lowest such temperature, but normally at temperatures in the range of about 50° C. up to about 300° C. provided 300° C. does not exceed the decomposition point. Temperatures of about 50° C. to about 200° C. can be used.

Because the acylating agents (A) can be reacted with ammonia and the amines (B) in the same manner as the high molecular weight acylating agents of the prior art are so reacted, U.S. Pat. Nos. 3,172,892; 3,219,666; 3,272,746; and 4,234,435 are expressly incorporated herein by reference for their disclosures with respect to the procedures applicable to reacting the acylating agents (A) with ammonia and amines (B).

In one embodiment, the acylating agent (A) is reacted with from about 0.5 to about 3, preferably about 0.5 to about 2, more preferably about 0.5 to about 1.5, more preferably about 0.8 to about 1.2 equivalents of ammonia or amine (B) per equivalent of acylating agent (A). In other embodiments, increasing amounts of the ammonia or amine (B) can be used.

The number of equivalents of the acylating agent (A) depends on the total number of carboxylic functions present.

In determining the number of equivalents for the acylating agents, those carboxyl functions which are not capable of reacting as a carboxylic acid acylating agent are excluded. In general, however, there is one equivalent of acylating agent for each carboxy group in these acylating agents. For example, there are two equivalents in an anhydride derived from the reaction of one mole of olefin polymer and one mole of maleic anhydride. Conventional techniques are readily available for determining the number of carboxyl functions (e.g., acid number, saponification number) and, thus, the number of equivalents of the acylating agent can be readily determined by one skilled in the art.

An equivalent weight of a mono-amine is the molecular weight of the amine. The equivalent weight of a commercially available mixture of mono-amines can be determined by dividing the atomic weight of nitrogen (14) by the % N contained in the mono-amine mixture, and multiplying by 100; thus, a mono-amine mixture containing 12.17% N would have an equivalent weight of 115.

An equivalent weight of a hydroxyamine to be reacted with the acylating agent under amide- or imide-forming conditions is its molecular weight divided by the total number of nitrogens present in the molecule. Under such conditions, the hydroxyl groups are ignored when calculating equivalent weight. Thus, ethanolamine would have an equivalent weight equal to its molecular weight, and diethanolamine would have an equivalent weight (based on nitrogen) equal to its molecular weight when such amines are reacted under amide- or imide-forming conditions.

The equivalent weight of a hydroxyamine to be reacted with the acylating agent under ester-forming conditions is its molecular weight divided by the number of hydroxyl groups present, and the nitrogen atoms present are ignored. Thus, when preparing esters from diethanolamine, the equivalent weight of the diethanolamine is one-half of its molecular weight.

The amount of ammonia or amine (B) that is reacted with the acylating agent (A) may also depend in part on the type of nitrogen atom present. One —$NH_2$ group can react with two —COOH groups to form an imide. If the nitrogen is secondary, each >NH group can react with only one —COOH group. Accordingly, the amount of mono-amine to be reacted with the acylating agent to form the carboxylic derivatives of the invention can be readily determined from a consideration of the types of nitrogen atom in the mono-amine (i.e., —$NH_2$, >NH and >N—).

In addition to the relative amounts of acylating agent (A) and ammonia or amine (B) used to form the carboxylic derivative composition, other important features of the carboxylic derivative compositions used in this invention are the Mn and the Mw/Mn values of the polyalkene as well as the presence within the acylating agents of an average of at least 1.3 succinic groups for each equivalent weight of substituent groups.

The preparation of the acylating agents (A) is illustrated in the following Examples 1–10, and the preparation of the carboxylic acid derivative compositions useful as emulsifiers in the inventive emulsions is illustrated in Examples A–D. In the following examples, and elsewhere in the specification and claims, all temperatures are in degrees Centigrade, and all percentages and parts are by weight, unless otherwise clearly indicated.

EXAMPLE 1

A mixture of 1000 parts of polyisobutene (Mn=1750; Mw=6300) and 106 parts of maleic anhydride is heated to 138° C. This mixture is heated to 190° C. in 9–14 hours during which time 90 parts of liquid chlorine are added. The reaction mixture is adjusted with chlorine addition, maleic anhydride addition or nitrogen blowing as needed to provide a polyisobutene-substituted succinic acylating agent composition with a total acid number of 95, a free maleic anhydride content of no more than 0.6% by weight, and a chlorine content of about 0.8% by weight. The composition has flash point of 180° C., a viscosity at 150° C. of 530 cSt, and a viscosity at 100° C. of 5400 cSt. The ratio of succinic groups to equivalent weights of polyisobutene in the acylating agent is 1.91.

EXAMPLE 2

A mixture of 510 parts of polyisobutene (Mn=1845; Mw=5325) and 59 parts of maleic anhydride is heated to 110° C. This mixture is heated to 190° C. in 7 hours during which 43 parts of gaseous chlorine is added beneath the surface. At 190–192° C. an additional 11 parts of chlorine is added over 3.5 hours. The reaction mixture is stripped by heating at 190–193° C. with nitrogen blowing for 10 hours. The residue is the desired polyisobutene-substituted succinic acylating agent having a saponification equivalent number of 87 as determined by ASTM procedure D-94.

EXAMPLE 3

A mixture of 1000 parts of polyisobutene (Mn=2020; Mw=6049) and 115 parts (1.17 moles) of maleic anhydride is heated to 110° C. This mixture is heated to 184° C. in 6 hours during which 85 parts of gaseous chlorine is added beneath the surface. At 184–189° C. an additional 59 parts of chlorine is added over 4 hours. The reaction mixture is stripped by heating at 186–190° C. with nitrogen blowing for 26 hours. The residue is the desired polyisobutene-substituted succinic acylating agent having a saponification equivalent number of 87 as determined by ASTM procedure D-94.

EXAMPLE 4

A mixture of polyisobutene chloride, prepared by the addition of 251 parts of gaseous chlorine to 3000 parts of polyisobutene (Mn=1696; Mw=6594) at 80° C. in 4.66 hours, and 345 parts of maleic anhydride is heated to 200° C. in 0.5 hour. The reaction mixture is held at 200–224° C. for 6.33 hours, stripped at 210° C. under vacuum and filtered. The filtrate is the desired polyisobutene-substituted succinic acylating agent having a saponification equivalent number of 94 as determined by ASTM procedure D-94.

EXAMPLE 5

A mixture of 3000 parts of polyisobutene (Mn=1845; Mw=5325) and 344 parts of maleic anhydride is heated to 140° C. This mixture is heated to 201° C. in 5.5 hours during which 312 parts of gaseous chlorine is added beneath the surface. The reaction mixture is heated at 201–236° C. with nitrogen blowing for 2 hours and stripped under vacuum at 203° C. The reaction mixture is filtered to yield the filtrate as the desired polyisobutene-substituted succinic acylating agent having a saponification equivalent number of 92 as determined by ASTM procedure D-94.

EXAMPLE 6

A mixture of 3000 parts of polyisobutene (Mn=2020; Mw=6049) and 364 parts of maleic anhydride is heated at 220° C. for 8 hours. The reaction mixture is cooled to 170° C. At 170–190° C., 105 parts of gaseous chlorine are added beneath the surface in 8 hours. The reaction mixture is heated at 190° C. with nitrogen blowing for 2 hours and then stripped under vacuum at 190° C. The reaction mixture is filtered to yield the filtrate as the desired polyisobutene-substituted succinic acylating agent.

EXAMPLE 7

A mixture of 800 parts of a polyisobutene falling within the scope of the claims of the present invention and having an Mn of about 2000, 646 parts of mineral oil and 87 parts of maleic anhydride is heated to 179° C. in 2.3 hours. At 176–180° C., 100 parts of gaseous chlorine is added beneath the surface over a 19 hour period. The reaction mixture is stripped by blowing with nitrogen for 0.5 hour at 180° C. The residue is an oil-containing solution of the desired polyisobutene-substituted succinic acylating agent.

EXAMPLE 8

The procedure for Example 2 is repeated except the polyisobutene (Mn=1845; Mw=5325) is replaced on an equimolar basis by polyisobutene (Mn=1457; Mw=5808).

EXAMPLE 9

The procedure for Example 2 is repeated except the polyisobutene (Mn=1845; Mw=5325) is replaced on an equimolar basis by polyisobutene (Mn=2510; Mw=5793).

EXAMPLE 10

The procedure for Example 2 is repeated except the polyisobutene (Mn=1845; Mw=5325) is replaced on an equimolar basis by polyisobutene (Mn=3220; Mw-5660).

EXAMPLE A

A mixture of 4920 parts (8.32 equivalents) of the polyisobutene-substituted succinic acylating agent prepared in accordance with the teachings of Example 1 and 2752 parts of a 40 Neutral oil are heated to 50–55° C. with stirring. 742 parts (8.32 equivalents) of dimethylethanolamine are added over a period of 6 minutes. The reaction mixture exotherms to 59° C. The reaction mixture is heated to 115° C. over a period of 3 hours. Nitrogen blowing is commenced at a rate of 1.5 standard cubic feet per hour, and the reaction mixture is heated to 135° C. over a period of 0.5 hour. The mixture is heated to and maintained at a temperature of 140–160° C. for 14 hours, then cooled to room temperature to provide the desired product. The product has a nitrogen content of 1.35% by weight, a total acid number of 13.4, a total base number of 54.8, a viscosity at 100° C. of 125 cSt, a viscosity at 40° C. of 2945 cSt, a specific gravity at 15.6° C of 0.94, and a flash point of 82° C.

EXAMPLE B

A mixture of 1773 parts (3 equivalents) of the polyisobutene-substituted succinic acylating agent prepared in accordance with the teachings of Example 1 and 992 parts of a 40 Neutral oil are heated to 80° C. with stirring. 267 parts (3 equivalents) of dimethylethanolamine are added over a period of 6 minutes. The reaction mixture is heated to 132° C. over a period of 2.75 hours. The mixture is heated to and maintained at a temperature of 150–174° C. for 12 hours, then cooled to room temperature to provide the desired product. The product has a nitrogen content of 0.73% by weight, a total acid number of 12.3, a total base number of 29.4, a viscosity at 100° C. of 135 cSt, a viscosity at 40° C. of 2835 cSt, a specific gravity at 15.6° C. of 0.933, and a flash point of 97° C.

EXAMPLE C

The procedure of Example B is repeated except that after the product is cooled to room temperature, 106 parts of dimethylethanolamine are added with stirring. The resulting product has a nitrogen content of 1.21% by weight, a total acid number of 11.3, a total base number of 48.9, a viscosity at 100° C. of 110 cSt, a viscosity at 40° C. of 2730 cSt, a specific gravity at 15.6° C. of 0.933, and a flash point of 90° C.

Sensitizers

In one embodiment of the invention, closed-cell, void-containing materials are used as sensitizing components. The term "closed-cell, void-containing material" is used herein to mean any particulate material which comprises closed cell, hollow cavities. Each particle of the material can contain one or more closed cells, and the cells can contain a gas, such as air, or can be evacuated or partially evacuated. In one embodiment of the invention, sufficient closed cell, void containing material is used to yield a density in the resulting emulsion of from about 0.8 to about 1.35 g/cc, more preferably about 0.9 to about 1.3 g/cc, more preferably about 1.1 to about 1.3 g/cc. In general, the emulsions of the subject invention can contain up to about 15% by weight, preferably from about 0.25% to about 15% by weight of the closed cell void containing material. Preferred closed cell void containing materials are discrete glass spheres having a particle size within the range of about 10 to about 175 microns. In general, the bulk density of such particles can be within the range of about 0.1 to about 0.4 g/cc. Useful glass microbubbles or microballoons which can be used are the microbubbles sold by 3M Company and which have a particle size distribution in the range of from about 10 to about 160 microns and a nominal size in the range of about 60 to 70 microns, and densities in the range of from about 0.1 to about 0–4 g/cc. Microballoons identified by the industry designation C15/250 which have a particle density of 0.15 gm/cc and 10% of such microballoons crush at a static pressure of 250 psig can be used. Also, microballoons identified by the designation B37/2000 which have a particle density of 0.37 gm/cc and 10% of such microballoons crush at a static pressure of 2000 psig can be used. Other useful glass microballoons are sold under the trade designation of ECCOSPHERES by Emerson & Cumming, Inc., and generally have a particle size range from about 44 to about 175 microns and a bulk density of about 0.15 to about 0.4 g/cc. Other suitable microballoons include the inorganic microspheres sold under the trade designation of Q-CEL by Philadelphia Quartz Company.

The closed cell, void containing material can be made of inert or reducing materials. For example, phenol-formaldehyde microbubbles can be utilized within the scope of this invention. If the phenol-formaldehyde microbubbles are utilized, the microbubbles themselves are a fuel component for the explosive and their fuel value should be taken into consideration when designing a water-in-oil emulsion explosive composition. Another closed cell, void containing material which can be used within the scope of the subject invention is the Saran microspheres sold by Dow Chemical Company. The saran microspheres have a diameter of about 30 microns and a particle density of about 0.032 g/cc. Because of the low bulk density of the saran microspheres, it is preferred that only from about 0.25 to about 1% by weight thereof be used in the water-in-oil emulsions of the subject invention.

Gas bubbles which are generated in-situ by adding to the composition and distributing therein a gas-generating material such as, for example, an aqueous solution of sodium nitrite, can also be used can be used to sensitize the explosive emulsions. Other suitable sensitizing components which may be employed alone or in addition to the foregoing include insoluble particulate solid self-explosives or fuel such as, for example, grained or flaked TNT, DNT, RDX and the like, aluminum, aluminum alloys, silicon and ferrosilicon; and water-soluble and/or hydrocarbon-soluble organic sensitizers such as, for example, amine nitrates, alkanolamine nitrates, hydroxyalkyl nitrates, and the like. The explosive emulsions of the present invention may be formulated for a wide range of applications. Any combination of sensitizing components may be selected in order to provide an explosive composition of virtually any desired density, weight-strength or critical diameter. The quantity of solid self-explosives or fuels and of water-soluble and/or hydrocarbon-soluble organic sensitizers may comprise up to about 50% by weight of the total explosive composition. The volume of the occluded gas component may comprise up to about 50% of the volume of the total explosive composition.

Particulate-Solid Oxygen-Supplying Salts

In one embodiment, particulate-solid oxygen-supplying salts may be incorporated into or blended with the inventive emulsions to increase the explosive energy of such emulsions. These salts can be ammonium nitrate, sodium nitrate, calcium nitrate or mixtures of two or more thereof. Ammonium nitrate is particularly useful. These particulate solids can be in the form of prills, crystals or flakes. Ammonium nitrate prills are especially useful.

In one embodiment ammonium nitrate prills made by the Kaltenbach-Thoning (KT) process are used. This process involves the use of one or more crystal growth modifiers to help control the growth of the crystals. It also involves the use of one or more surfactants which are used to reduce caking. An example of a commercially available material made by this process is Columbia KT ammonium nitrate prills which are marketed by Columbia Nitrogen. The crystal habit modifier and the surfactant used in the production of Columbia KT prills are each available under the trade designation Galoryl.

Ammonium nitrate particulate solids, (e.g., ammonium nitrate prills), which are available in the form of preblended ammonium nitrate-fuel oil (ANFO) mixtures, can be used. Typically, ANFO contains about 94% by weight ammonium nitrate and about 6% fuel oil (e.g., diesel fuel oil), although these proportions can be varied.

The quantities of these particulate-solid oxygen-supplying salts or ANFO that are used can comprise up to about 80% by weight of the total explosive composition. In one embodiment of the invention, explosive compositions comprising about 25% to about 35% by weight of the inventive emulsion and about 65% to about 75% of particulate solid, oxygen-supplying salts or ANFO are used. In one embodiment, explosive compositions comprising about 45% to about 55% by weight of the inventive emulsion and about 45% to about 55% of particulate solid, oxygen-supplying salts or ANFO are used. In one embodiment, explosive compositions comprising about 70% to about 80% by weight of the inventive emulsion and about 20% to about 30% of particulate solid, oxygen-supplying salts or ANFO are used.

Supplemental Additives

Supplemental additives may be incorporated in the emulsions of the invention in order to further improve sensitivity, density, strength, rheology and cost of the final explosive. Typical of materials found useful as optional additives include, for example, particulate non-metal fuels such as sulfur, gilsonite and the like; particulate inert materials such as sodium chloride, barium sulphate and the like; thickeners such as guar gum, polyacrylamide, carboxymethyl or ethyl cellulose, biopolymers, starches, elastomeric materials, and the like; crosslinkers for the thickeners such as potassium pyroantimonate and the like; buffers or pH controllers such as sodium borate, zinc nitrate and the like; crystals habit modifiers such as alkyl naphthalene sodium sulphonate and the like; liquid phase extenders such as formamide, ethylene glycol and the like; and bulking agents and additives of common use in the explosives art. The quantities of supplemental additives used may comprise up to about 50% by weight of the total explosive composition.

Method of Making the Emulsions

A useful method for making the emulsions of the invention comprises the steps of (1) mixing water, inorganic oxidizer salts (e.g., ammonium nitrate) and, in certain cases, some of the supplemental water-soluble compounds, in a first premix, (2) mixing the carbonaceous fuel, the emulsifier of the invention and any other optional oil-soluble compounds, in a second premix and (3) adding the first premix to the second premix in a suitable mixing apparatus, to form a water-in-oil emulsion. The first premix is heated until all the salts are completely dissolved and the solution may be filtered if needed in order to remove any insoluble residue. The second premix is also heated to liquefy the ingredients. Any type of apparatus capable of either low or high shear mixing can be used to prepare these water-in-oil emulsions. Closed-cell, void containing materials, gas-generating materials, solid self-explosive ingredients such as particulate TNT, particulate-solid oxygen-supplying salts such as ammonium nitrate prills and ANFO, solid fuels such as aluminum or sulfur, inert materials such as barytes or sodium chloride, undissolved solid oxidizer salts and other optional materials, if employed, are added to the emulsion and simply blended until homogeneously dispersed throughout the composition.

The water-in-oil explosive emulsions of the invention can also be prepared by adding the second premix liquefied organic solution phase to the first premix hot aqueous solution phase with sufficient stirring to invert the phases. However, this method usually requires substantially more energy to obtain the desired dispersion than does the preferred reverse procedure. Alternatively, these water-in-oil explosive emulsions are particularly adaptable to preparation by a continuous mixing process where the two separately prepared liquid phases are pumped through a mixing device wherein they are combined and emulsified.

The emulsifiers of this invention can be added directly to the inventive emulsions. They can also be diluted with a substantially inert, normally liquid organic diluent such as mineral oil, naphtha, benzene, toluene or xylene, to form an additive concentrate. These concentrates usually contain from about 10% to about 90% by weight of the emulsifier composition of this invention and may contain, in addition, one or more other additives known in the art or described hereinabove.

Examples I–IX are directed to explosive emulsions using the emulsifier prepared in accordance with the teachings of Example A. The formulations for these explosive emulsions are indicated below in Table I (all numerical amounts being in grams). The procedure for making these emulsions involves the following steps. The ammonium nitrate is mixed with the water at a temperature of 82° C. The emulsifier is mixed with the mineral oil at a temperature of 52° C. The mixture of ammonium nitrate and water is added to the mixture of oil and emulsifier to form a water-in-oil emulsion. The glass microballoons are then added. Each of these explosive emulsions are useful as blasting agents.

TABLE I

| Example No. | I | II | III | IV | V | VI | VII | VIII | IX |
|---|---|---|---|---|---|---|---|---|---|
| Ammonium Nitrate | 7440 | 7636 | 7636 | 7200 | 8500 | 7700 | 7200 | 8500 | 7700 |
| Water | 1610 | 1564 | 1564 | 2000 | 1000 | 1500 | 2000 | 1000 | 1500 |
| Klearol oil (refined mineral oil, Witco) | 800 | — | — | — | — | — | — | — | — |
| Mentor 28 (mineral seal oil, Exxon) | — | 700 | — | — | — | — | — | — | — |
| 40 Neutral Oil | — | — | 700 | 700 | 400 | 750 | 100 | 100 | 50 |
| C15/250 Glass Microballoons | 100 | 100 | 100 | 100 | 250 | 150 | 100 | 250 | 150 |
| Product of Ex. A | 150 | 100 | 100 | 100 | 100 | 50 | 700 | 400 | 750 |

EXAMPLE X

The following emulsion is prepared using Columbia KT ammonium nitrate prills (a product of Columbia Nitrogen identified as ammonium nitrate prills made using the Kaltenbach-Thoring process employing a crystal growth modifier and a surfactant, each of which is available under the table designation Galoryl). The formulation for this emulsion is provided in Table II (all numerical amounts being in grams).

TABLE II

| | |
|---|---|
| Ammonium Nitrate | 534.52 |
| Columbia KT prills | 229.08 |
| Water | 156.40 |
| 40 Neutral oil | 65.00 |
| Product of Ex. A | 15.00 |

The emulsion in Table II is prepared by mixing the ammonium nitrate with the water and then melting the Columbia KT prills in the ammonium nitrate and water. The emulsifier from Example A is mixed with the 40 Neutral oil. The mixture of ammonium nitrate, water and Columbia KT prills is added to the mixture of oil and emulsifier. The resulting emulsion is creamy (no graininess) three months after it is made.

Examples XI–XIX are directed to explosive compositions consisting of mixtures of the emulsions from Examples I–III and ANFO. The ANFO is a mixture of ammonium nitrate solids (94% by weight) and diesel fuel oil (6% by weight). The formulations are indicated in Table III (all numerical amounts being in grams).

TABLE III

| Example No. | XI | XII | XIII | XIV | XV | XVI | XVII | XVIII | XIX |
|---|---|---|---|---|---|---|---|---|---|
| Emulsion from Ex. I | 300 | — | — | 500 | — | — | 750 | — | — |
| Emulsion from Ex. II | — | 300 | — | — | 500 | — | — | 750 | — |
| Emulsion from Ex. III | — | — | 300 | — | — | 500 | — | — | 750 |
| ANFO | 700 | 700 | 700 | 500 | 500 | 500 | 250 | 250 | 250 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A water-in-oil emulsion comprising: a discontinuous aqueous phase comprising at least one oxygen-supplying component; a continuous organic phase comprising at least one carbonaceous fuel; at least one crystal habit modifier; and a minor emulsifying amount of at least one emulsifier made by the reaction of component (A) with component (B), component (A) being at least one polyalkenyl substituted succinic acylating agent, said acylating agents being characterized by the presence within their structure of an average of at least 1.3 succinic groups for each equivalent weight of polyalkenyl groups wherein the polyalkenyl group has a Mn/Mw value from about 1.5 to about 5, and component (B) being ammonia and/or at least one monoamine.

2. The emulsion of claim 1 wherein said acylating agents are characterized by the presence within their structure of about 1.5 to about 2.5 succinic groups for each equivalent weight of substituent groups.

3. The emulsion of claim 1 wherein said polyalkene has an Mn of at least about 500.

4. The emulsion of claim 1 wherein said polyalkene has an Mn value of about 1300 to about 5000 and an Mw/Mn value of about 2.8 to about 5.

5. The emulsion of claim 1 wherein the substituent groups in component (A) are derived from one or more polyalkenes selected from the group consisting of homopolymers and interpolymers of terminal olefins of from 2 to about 16 carbon atoms with the proviso that said interpolymers can optionally contain up to about 25% of polymer units derived from internal olefins of up to about 6 carbon atoms.

6. The emulsion of claim 1 wherein the substituent groups in component (A) are derived from a member selected from the group consisting of polybutene, polypropylene, ethylene-propylene interpolymer, styrene-diene interpolymer, and mixtures of two or more of any of these.

7. The emulsion of claim 1 wherein the substituent groups in component (A) are derived from polybutene in which at least about 50% of the total units derived from butenes is derived from isobutene.

8. The emulsion of claim 1 wherein component (B) is at least one hydroxyamine.

9. The emulsion of claim 1 wherein component (B) is at least one tertiary amine.

10. The emulsion of claim 1 wherein component (B) is at least one alkanol tertiary monoamine.

11. The emulsion of claim 1 wherein component (B) is (a) at least one N-(hydroxyl-substituted hydrocarbyl) amine, (b) at least one hydroxyl- substituted poly(hydrocarbyloxy) analog of (a), or (c) a mixture of (a) and (b).

12. The emulsion of claim 1 wherein component (B) is at least one alkanol amine containing up to about 40 carbon atoms.

13. The emulsion of claim 1 wherein component (B) is selected from the group consisting of (a) secondary and tertiary alkanol amines represented correspondingly by the formulae

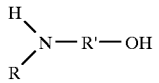

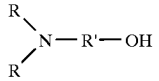

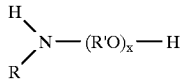

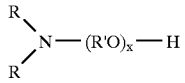

(b) hydroxyl-substituted oxyalkylene analogs of said alkanol amines represented by the formulae

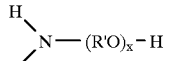

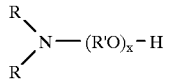

wherein x is from about 2 to about 15, each R is independently a hydrocarbyl group of 1 to about 8 carbon atoms or a hydroxyl-substituted hydrocarbyl group of 2 to about 8 carbon atoms and R' is a divalent hydrocarbyl group of 2 to about 18 carbon atoms, and (c) mixtures of two or more thereof.

14. The emulsion of claim 1 wherein component (B) is represented by the formula

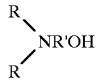

wherein each R is independently an alkyl group of 1 to about 4 carbon atoms and R' is an alkylene group of2 to about 4 carbon atoms.

15. The emulsion of claim 1 wherein component (B) is dimethyl ethanolamine.

16. The emulsion of claim 1 wherein the equivalent ratio of component (A) to component (B) is in the range of about 1:0.5 to about 1:3.

17. The emulsion of claim 1 wherein said oxygen supplying component is ammonium nitrate and/or one or more alkali or alkaline earth metal nitrates, chlorates or perchlorates.

18. The emulsion of claim 1 wherein said oxygen supplying component is ammonium nitrate.

19. The emulsion of claim 1 wherein said carbonaceous fuel is a water-immiscible, emulsifiable hydrocarbon that is either liquid or liquefiable at a temperature up to about 95° C.

20. The emulsion of claim 1 wherein said discontinuous aqueous phase is present at a level of about 85% to about 98% by weight based on the weight of said emulsion and said continuous organic phase is present at a level of about 2% to about 15% by weight based on the weight of said emulsion, said oxygen-supplying component is present at a level in the range of about 70% to about 95% by weight based on the weight of said aqueous phase, and said emulsifier is present at a level in the range of about 5% to about 95% by weight based upon the weight of said organic phase.

21. The emulsion of claim 1 wherein said emulsion contains a sensitizing amount of at least one closed-cell, void-containing material.

22. The emulsion of claim 1 wherein said emulsion contains a sensitizing amount of glass microballoons.

23. The emulsion of claim 1 wherein said emulsion contains a sensitizing amount of gas bubbles.

24. The emulsion of claim 1 wherein said emulsion contains up to about 80% by weight of particulate solid oxygen-containing salts dispersed therein.

25. The emulsion of claim 24 wherein said particulate solids are selected from the group consisting of ammonium nitrate, sodium nitrate, calcium nitrate and mixtures of two or more thereof.

26. The emulsion of claim 1 wherein said emulsion contains up to about 80% by weight of ammonium nitrate particulate solids.

27. The emulsion of claim 1 wherein component (B) is dimethyl-ethanolamine and said emulsion contains up to about 80% by weight of ammonium nitrate particulate solids, said ammonium nitrate particulate solids being made using at least one crystal habit modifier and at least one surfactant.

28. The emulsion of claim 1 wherein said emulsion contains up to about 80% by weight of a preblended ammonium nitrate-fuel oil mixture.

29. The emulsion of claim 1 wherein said emulsion contains up to about 50% by weight of a particulate metal fuel selected from the group consisting of aluminum, aluminum alloys, silicon and ferro-silicon.

30. The emulsion of claim 1 wherein said emulsion contains up to about 50% by weight of a particulate solid fuel.

31. The emulsion of claim 1 wherein said emulsion contains up to about 50% by weight of a particulate solid inert material.

32. The emulsion of claim 1 wherein said emulsion contains a thickening amount of at least one thickener.

33. The emulsion of claim 19 wherein the carbonaceous fuel is Diesel fuel.

34. A water-in-oil emulsion comprising: a discontinuous aqueous phase comprising at least one oxygen-supplying component; a continuous organic phase comprising at least one carbonaceous fuel; at least one crystal habit modifier;

and a minor emulsifying amount of at least one emulsifier made by the acylating reaction of component (A) with component (B), component (A) being at least one polyalkenyl substituted succinic acylating agent, said polyalkenyl group has an $\overline{M}n$ of at least about 1300 and an $\overline{M}w/\overline{M}n$ of about 2.8 to about 5, said acylating agents being characterized by the presence within their structure of an average of at least 1.3 succinic groups for each equivalent weight of substituent groups, and component (B) being ammonia and/or at least one monoamine.

35. A water-in-oil emulsion comprising: a discontinuous aqueous phase comprising at least one oxygen-supplying component; a continuous organic phase comprising at least one carbonaceous fuel; at least one crystal habit modifier; and a minor emulsifying amount of at least one compound made by the reaction of component (A) with component (B), component (A) being at least one polybutenyl substituted succinic acylating agent, wherein at least about 50% of the total units of the polybutenyl group which are derived from butenes are derived from isobutene, said polybutenyl group has an Mn value of at least about 1000, said acylating agents being characterized by the presence within their structure of an average of at least 1.3 succinic groups for each equivalent weight of substituent groups, and component (B) being at least one secondary and/or tertiary hydroxymonoamine.

36. A water-in-oil emulsion comprising: a discontinuous aqueous phase comprising at least one oxygen-supplying component; a continuous organic phase comprising at least one carbonaceous fuel; at least one crystal habit modifier; and a minor emulsifying amount of at least one compound made by the reaction of component (A) with component (B), component (A) being at least one polybutenyl substituted succinic acylating agent, wherein at least about 50% of the total units of the polybutenyl group which are derived from butenes are derived from isobutene, said polybutenyl group has an Mn value of at least about 1000, said acylating agents being characterized by the presence within their structure of an average of at least 1.3 succinic groups for each equivalent weight of substituent groups, and component (B) being at least one alkanol tertiary monoamine.

37. A water-in-oil emulsion comprising: a discontinuous aqueous phase comprising at least one oxygen-supplying component; a continuous organic phase comprising at least one carbonaceous fuel; at least one crystal habit modifier; and a minor emulsifying amount of at least one compound made by reacting component (A) with component (B) under ester-forming conditions, component (A) being at least one polybutenyl substituted succinic acylating agent, wherein at least about 50% of the total units of the polybutenyl group which are derived from butenes are derived from isobutene, said polybutenyl group has an $\overline{M}n$ value of at least about 1500 to about 2000 and an $\overline{M}w/\overline{M}n$ value of about 2.8 to about 4.5, said acylating agents being characterized by the presence within their structure of an average of at least 1.7 to about 2.1 succinic groups for each equivalent weight of substituent groups, and component (B) being a compound represented by the formula

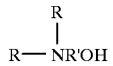

wherein each is independently an alkyl group of 1to about 4 carbon atoms and R' is an alkylene group of 2 to about 4 carbon atoms, the equivalent ratio of component (A) to component (B) being about 1:0.8 to about 1:1.2.

38. A water-in-oil emulsion comprising: a discontinuous aqueous phase comprising at least one oxygen-supplying component; a continuous organic phase comprising at least one carbonaceous fuel; at least one crystal habit modifier; and a minor emulsifying amount of at least one compound made by reacting component (A) with component (B) under ester-forming conditions, component (A) being at least one polybutenyl substituted succinic acylating agent, wherein at least about 50% of the total units of the polybutenyl group which are derived from butenes are derived from isobutene, said polybutenyl group has an $\overline{M}n$ value of at least about 1600 to about 1900 and an $\overline{M}w/\overline{M}n$ value of about 3.3 to about 3.8, said acylating agents being characterized by the presence within their structure of an average of at least 1.8 to about 2.0 succinic groups for each equivalent weight of substituent groups, and component (B) being dimethylethanolamine, the equivalent ratio of component (A) to component (B) being about 1:0.8 to about 1:1.2.

39. An explosive composition comprising a water-in-oil emulsion and up to about 80% by weight of a preblended ammonium nitrate-fuel oil mixture, wherein the ammonium nitrate is prepared with at least one crystal habit modifier.

said water-in-oil emulsion comprising: a discontinuous aqueous phase comprising at least one oxygen-supplying component; a continuous organic phase comprising at least one carbonaceous fuel; and a minor emulsifying amount of at least one compound made by the acylating reaction of component (A) with component (B), component (A) being at least one polybutenyl substituted succinic acylating agent, wherein at least about 50% of the total units derived of the polybutenyl group which are from butenes are derived from isobutene, said polybutenyl group has an $\overline{M}n$ value of at least about 1300, said acylating agents being characterized by the presence within their structure of an average of at least 1.3 succinic groups for each equivalent weight of substituent groups, and component (B) being at least one alkanol tertiary monoamine .8.

40. An explosive composition comprising a water-in-oil emulsion and up to about 80% by weight of ammonium nitrate particulate solids, said ammonium nitrate particulate solids being made using at least one crystal habit modifier and at least one surfactant, said water-in-oil emulsion comprising: a discontinuous aqueous phase comprising at least one oxygen-supplying component; a continuous organic phase comprising at least one carbonaceous fuel; and a minor emulsifying amount of at least one compound made by reacting component (A) with component (B) under ester-forming conditions, component (A) comprising at least one polybutenyl substituted succinic acylating agent, wherein at least about 50% of the total units of the polybutenyl group which are derived from butenes are derived from isobutene, said polybutenyl group has an $\overline{M}n$ value of at least about 1600 to about 1900 and an $\overline{M}w/\overline{M}n$ value of about 3.3 to about 3.9, said acylating agents being characterized by the presence within their structure of an average of at least 1.7 to about 2.1 succinic groups for each equivalent weight of substituent groups, and component (B) being dimethylethanolamine, the equivalent ratio of component (A) to component (B) being about 1:0.8 to about 1:1.2.

* * * * *